US005224534A

United States Patent [19]

Shimizu et al.

[11] Patent Number: 5,224,534

[45] Date of Patent: Jul. 6, 1993

[54] METHOD OF PRODUCING REFRACTORY METAL OR ALLOY MATERIALS

[75] Inventors: Fumiyuki Shimizu; Toshiaki Kawata; Masayasu Ito; Takeshi Akazawa, all of Hitachi, Japan

[73] Assignee: Nippon Mining and Metals Company, Limited, Tokyo, Japan

[21] Appl. No.: 761,122

[22] Filed: Sep. 17, 1991

[30] Foreign Application Priority Data

Sep. 21, 1990 [JP] Japan ..... 2-253773
Sep. 21, 1990 [JP] Japan ..... 2-253775

[51] Int. Cl.[5] ..... B22D 11/10; B22D 27/02

[52] U.S. Cl. ..... 164/469; 164/494; 164/473

[58] Field of Search ..... 164/469, 470, 471, 494, 164/495, 496, 473

[56] References Cited

FOREIGN PATENT DOCUMENTS 3618531 12/1986 Fed. Rep. of Germany ..... 164/494
63-177955 7/1988 Japan ..... 164/469

*Primary Examiner*—Kuang Y. Lin

*Attorney, Agent, or Firm*—Seidel, Gonda, Lavorgna & Monaco

[57] ABSTRACT

There is provided a method of producing a refractory metal or refractory metal-based alloy material by electron beam cold hearth remelting which comprises melting and casting a meltable electrode, characterized in that the electrode used for electron beam cold hearth remelting is made by enveloping a material of refractory metal or refractory metal-based alloy to be melted with an enclosure formed from a metallic material having a higher vapor pressure than said particular refractory metal or from a metallic material which includes component or components having a higher vapor pressure than said particular refractory metal. The evaporation loss of the alloy component or components of the refractory metal-based alloy is compensated for with said metallic material or component(s) of the enclosure or otherwise any metallic material or component(s) of the enclosure provides at least a partial addition of the alloy component or components of the refractory metal-based alloy. Titanium sponge or titanium scrap may be produced into a slab with a square cross section and then directly rolling the slab without subjecting the slab to forging before the rolling.

7 Claims, 2 Drawing Sheets

METHOD OF PRODUCING REFRACTORY METAL OR ALLOY MATERIALS

FIELD OF THE INVENTION

This invention relates to a method of producing refractory metals, such as molybdenum, tungsten, or titanium, or alloy materials based on such a metal or metals by electron-beam cold hearth remelting. The invention makes possible the manufacture of refractory metal-based alloys with low impurity contents to target compositions at lower cost than heretofore. The invention also permits low-cost manufacture of high quality titanium or titanium alloy material mainly from titanium sponge or titanium scrap (for the purposes of the invention, including titanium alloy scrap).

BACKGROUND OF THE INVENTION

Recently, there have been remarkable technical innovations in machinery, component parts, and instruments, notably in the fields of electronics, atomic energy, and aerospace industries. These developments are whipping up widespread demand for the metals or alloy materials that were once regarded as very special. Today, such refractory metals as titanium, zirconium, hafnium, and vanadium and their alloys are in extensive use as quite common industrial materials. Indications are that metals with even higher melting points, e.g., niobium, molybdenum, tantalum, and tungsten, are about to play a prominent role as new industrial materials.

Ingots of the refractory metals or refractory metal-based alloy have thus far been made by either:

A) Compacting a refractory metal or its alloy in powder form under pressure and sintering the green compact to an ingot (sintering method) or;

B) Compression-molding a refractory metal or its alloy in powder or sponge form or scrap of a refractory metal or its alloy into an electrode or, as an alternative, packing the material into a box or tube of the same material to provide an electrode, and then melting the electrode by the electron beam melting technique to form an ingot (electron beam melting method).

These methods present problems for which there is a strong demand for solution.

Problems that have been pointed out in the practice of the sintering method include the following:

a) Large contents of impurities (especially gaseous components such as oxygen, nitrogen, carbon compounds, sulfur compound, and hydrogen) in the resulting ingot place a limit upon its fabrication into high-purity products. This hinders the application of the method to the manufacture of members for high-temperature high-vacuum uses because of the possibility of objectionable gas release.

b) Being a sintered material, the ingot poses a density problem.

c) The process requires many steps and is costly.

d) As a raw material for the ingot, scrap cannot be directly utilized.

The conventional electron beam melting method, when used in producing an ingot of alloy based on refractory metal, entails much evaporation loss of the alloy components during melting, often resulting in an ingot with a composition outside the intended limits. Another problem is the high cost of making the electrode to be melted. It is due to the general belief in the art that the electrode must be manufactured by packing raw material into a box or tube of the same material as that to be produced to avoid the intrusion of foreign matter. Also in the case of compression molding, the process involves arduous, complex steps leading to high cost.

For these and other reasons, neither method has been deemed fully satisfactory.

Meanwhile, great strides have in recent years been made in the technology for the manufacture of especially titanium among refractory metals. There is a tendency, accordingly, toward a broader range of applications and growing demand for pure titanium and titanium alloys because of their excellent specific strength and resistance to heat and corrosive attacks.

Pure Ti and Ti alloy materials generally have been made by the following procedures:

a) Pure titanium material

The method comprises joining by welding blocks made by compression molding of pure sponge titanium that results from titanium purification process or lumps of pure titanium scrap or both to form electrodes for vacuum arc melting, melting the electrodes in a vacuum arc melting furnace, casting the melt into an ingot having a circular cross section, and forging it followed by rolling into a plate or bar product.

b) Titanium alloy material

The method comprises compression-molding pure sponge titanium and/or titanium alloy scrap with the addition of such alloy components as aluminum and vanadium, welding the molded articles together to form electrodes for vacuum arc melting, melting the electrodes in a vacuum arc melting furnace, casting the melt into an ingot having a circular cross section and forging it followed by rolling into a plate or bar product.

These means conventionally employed for the manufacture of titanium materials, however, surface conditioning of the cast ingot or slab by frequent scalping at many stages during forging and rolling. This has offered the problem of low material yield and hindrance to cost reduction.

In addition to the high electrode cost, the ingot obtained by vacuum arc melting is prone to contain non-metallic inclusions such as TiN and other low density inclusions (LDI) and WC and other high density inclusions (HDI). These inclusions cannot be disregarded, since they can cause cracking of the material, leading to deteriorated mechanical properties and shortened life of the final product.

In this connection attention is being paid to a new technology, electron beam cold hearth remelting as proposed in U.S. Pat. Nos. 4,681,627 and 4,750,542. The process consists of enveloping a metal or alloy ingot or material obtained by vacuum arc melting or the like with an enclosure of the same material as the ingot or material to form a meltable electrode 5 as shown in FIG. 1, and then remelting and purifying the same using an electron beam melting apparatus which comprises a melting chamber in which a water-cooled cold hearth 2 of copper is installed before a water-cooled copper crucible (mold) 1. The meltable electrode 5 is melted by electron beams 4 from electron beam guns 3, and the molten material is once held in the cold hearth 2 under a vacuum (a reduced pressure) to evaporate impurities from the melt for purification. At the same time, the molten metal is caused to overflow the cold hearth 2 and is cast semicontinuously into the water-cooled copper crucible 1 to produce a rod 6 having a circular cross section. It is a melting method claimed to be particularly suited for the melting and purification of refractory metals.

As regards the meltable electrode, the U.S. Pat. No. 4,681,627 defined in claim 1: "- - - charging the metal scrap into a tubular member with a closed end and another end, said tubular member being made of the same material as that of the scrap," thus indicating the use of an enclosure of the same material as the charge to be melted.

However, further improvements in the electron beam cold hearth remelting are sought, especially for the lower cost and higher quality of the product.

OBJECT OF THE INVENTION

It is an object of the present invention to make further improvements in the electron beam cold hearth remelting so that a refractory metal or a refractory metal-based alloy with less impurity contents can be produced to an intended composition at lower cost than heretofore.

A specific object of the invention is to develop a method of producing a high-purity high-quality titanium or titanium alloy material at low cost predominantly from titanium sponge or titanium scrap (the term as used herein encompassing titanium alloy scrap too).

SUMMARY OF THE INVENTION

After an extensive and intensive research so far made with the view to realizing the above objects, we have now found the following:

a) Among metallic materials in use for structural members, there are some which have relatively high vapor pressures and are easy to obtain and process inexpensively, e.g., Ti, Fe, and Al. When a sheet, net, or the like of such a metal is used to envelop a virgin or scrap material of a refractory metal or a refractory metal-based alloy to be melted to form a meltable electrode and is melted with electron beams cold hearth remelting, impure gas components contained in small amounts in the material, such as O, N, S, C, and H, are effectively removed during the course of electron beam melting and surprisingly the enclosure component of a relatively high vapor pressure too can be preferentially evaporated from the molten material and depending on the melting conditions used (temperature, degree of vacuum, molten metal holding time, casting speed, etc.), the residual amount of the enclosure component can be controlled within a range from zero to a proper limit. Thus a component controlled ingot with an extremely small proportion of impurities such as gas components is obtained. This destroys the prevalent concept that the use of an enclosure of the same material as the charge for melting is essential for the preparation of an electrode to be melted.

b) In this case, the enclosure material to be used is made from a metallic material easy to be lost by evaporation or a metallic material containing a component or components easy to be lost by evaporation accompanied by proper adjustments of the melting conditions, fine control of the alloy composition is permitted during electron beam melting, hence giving a refractory metal-based alloy with a desired composition in a stable operation.

c) With titanium in particular, even when its meltable electrode is made by enveloping titanium sponge or titanium scrap with a sheet, net, or the like of aluminum or other metal having a higher vapor pressure than Ti or Ti alloys, good workability is assured as with a vacuum arc-melted ingot employed for the same purpose. An ingot with no contaminant from the enclosure may be produced. Although titanium sponge or titanium scrap is directly utilized as a material to be melted, the resulting slab is very sound with extremely low nonmetallic inclusions, such as LDI and HDI, and impurity elements, and with little compositional segregation.

d) Furthermore, direct casting of the molten metal, melt refined by electron beam cold hearth remelting, to produce a square slab, and rolling without the need of forging in advance are now possible. These result in cost reduction with fewer process steps involved and render it possible to achieve an improvement in material yield due to the elimination of scalping which would otherwise accompany forging.

On the basis of the foregoing discoveries, the present invention provides:

1. a method of producing a refractory metal or refractory metal-based alloy material by electron beam cold hearth remelting which comprises melting and casting a meltable electrode, characterized in that the electrode used for electron beam cold hearth remelting is made by enveloping a material of refractory metal or refractory metal-based alloy to be melted with an enclosure formed from a metallic material having a higher vapor pressure than said particular refractory metal or from a metallic material which includes component or components having a higher vapor pressure than said particular refractory metal,
2. a method according to 1 above wherein the material to be melted is a refractory metal-based alloy, the meltable electrode used for electron beam cold hearth remelting is made by enveloping the refractory metal-based alloy material to be melted with an enclosure formed from a metallic material having a higher vapor pressure than said particular refractory metal or from a metallic material includes component or components having a higher vapor pressure than said particular refractory metal, and the melting and casting of the electrode are carried out while adjusting the amount of evaporation of said higher vapor pressure material or component(s) during the melting,
3. a method according to 2 above wherein the evaporation loss of the alloy component or components of the refractory metal-based alloy is compensated for with said metallic material or component(s) of the enclosure,
4. a method according to 2 above wherein said metallic material or component(s) of the enclosure provides at least a partial addition of the alloy component or components of the refractory metal-based alloy,
5. a method according to 2 above wherein a Mo-Ti-Zr alloy material is produced using a meltable electrode formed by enveloping Mo scrap which contains both Ti and Zr with a pure Ti enclosure,
6. a method according to 1 above wherein the material to be melted is titanium sponge or titanium scrap or a mixture thereof and the meltable electrode is formed by enveloping a meltable material with an enclosure formed from a metallic material having a higher vapor pressure than titanium or from a metallic material includes component or components having a higher vapor pressure than titanium, the method comprising melting and casting the electrode to produce a slab with a square cross section, and then directly rolling the slab without subjecting the slab to forging before the rolling, and 7. A method according to 6 above wherein titanium or a titanium alloy is made using a meltable electrode formed by enveloping titanium sponge, titanium scrap, or a mixture thereof with an enclosure of pure aluminum.

DEFINITION OF TERMS

For the purposes of the invention the term "refractory metal-based alloy" as used herein is not limitative. It collectively denotes any of alloys based on a refractory metal, such as No, W, Ta, Nb, Zr, Ti, Hf, or V, and having a high enough melting point for electron beam melting.

The expression "an enclosure formed from a metallic material which includes component or components having a higher vapor pressure than said particular refractory metal" is herein used to mean, for example, a sheet, net, or the like made of:

a) An alloy of a refractory metal as the base and an alloy component metal having a higher vapor pressure than the base;

b) An alloy of an alloy component metal having a higher vapor pressure than a refractory metal as the base and a metal having an even higher vapor pressure;

c) An alloy of a refractory metal as the base, an alloy component metal having a higher vapor pressure than the base, and a metal having an even higher vapor pressure than the alloy component metal; or d) A mechanical composite of an alloy component metal having a higher vapor pressure than a refractory metal as the base and either a refractory metal as the base or a metal having an even higher vapor pressure than the alloy component metal or both.

Desirably, such a sheet, net, or the like is used as fabricated into a container, such as a tube, cylinder, or box.

By the expression "a meltable electrode made predominantly from titanium sponge or titanium scrap or both" is meant an electrode for electron beam melting formed from titanium sponge, titanium scrap, or their mixture, with or without the addition of another alloying element or elements.

DETAILED DESCRIPTION OF THE INVENTION

Figure 1:
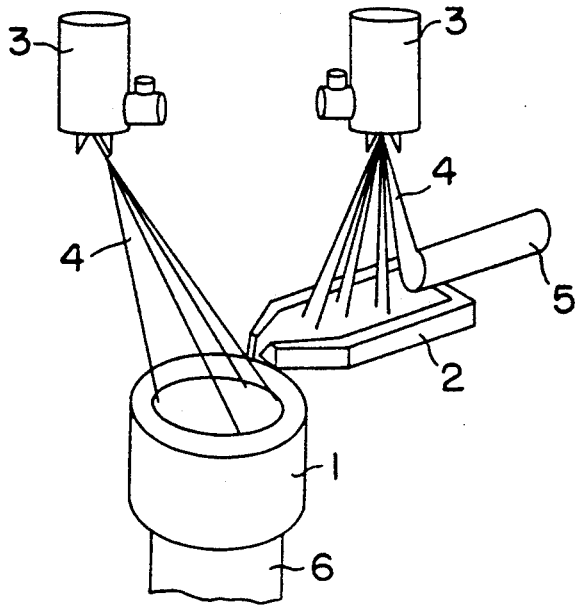
FIG. 1 is a perspective view illustrating the principle of electron beam cold hearth remelting, with a meltable electrode, water-cooled copper crucible (mold), and a water-cooled cold hearth shown.
Figure 2:
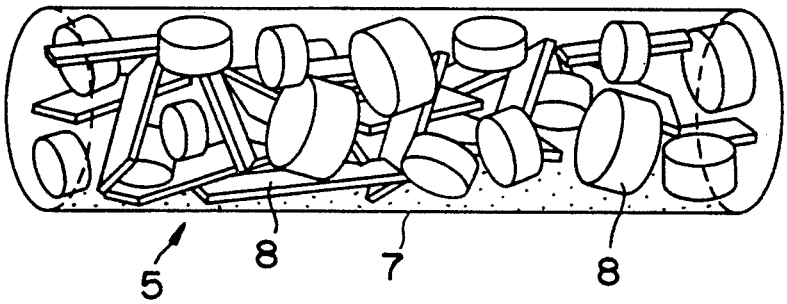
FIG. 2 is a diagrammatic view of a meltable electrode according to the invention.

Referring now to FIG. 2, there is shown a typical meltable electrode 5 according to the present invention. The electrode consists of a cylindrical body (enclosure) 7 formed of a sheet of a metallic material (e.g., pure Ti, Al) having a higher vapor pressure than refractory metal involved or from a metallic material (e.g., alloys including Ti, Al etc.) which includes component or components having a higher vapor pressure than the refractory metal and packed with a virgin or scrap material of the refractory metal-based alloy or a singular metallic material 8 of the alloy components mixed in a desired compositional ratio, directly without being compression molded. It is, of course, possible alternatively to compression mold the virgin or scrap material of the refractory metal-based alloy or the singular metallic material 8 of the alloy components and envelop it with the cylindrical body 7 or the like.

Figure 3:
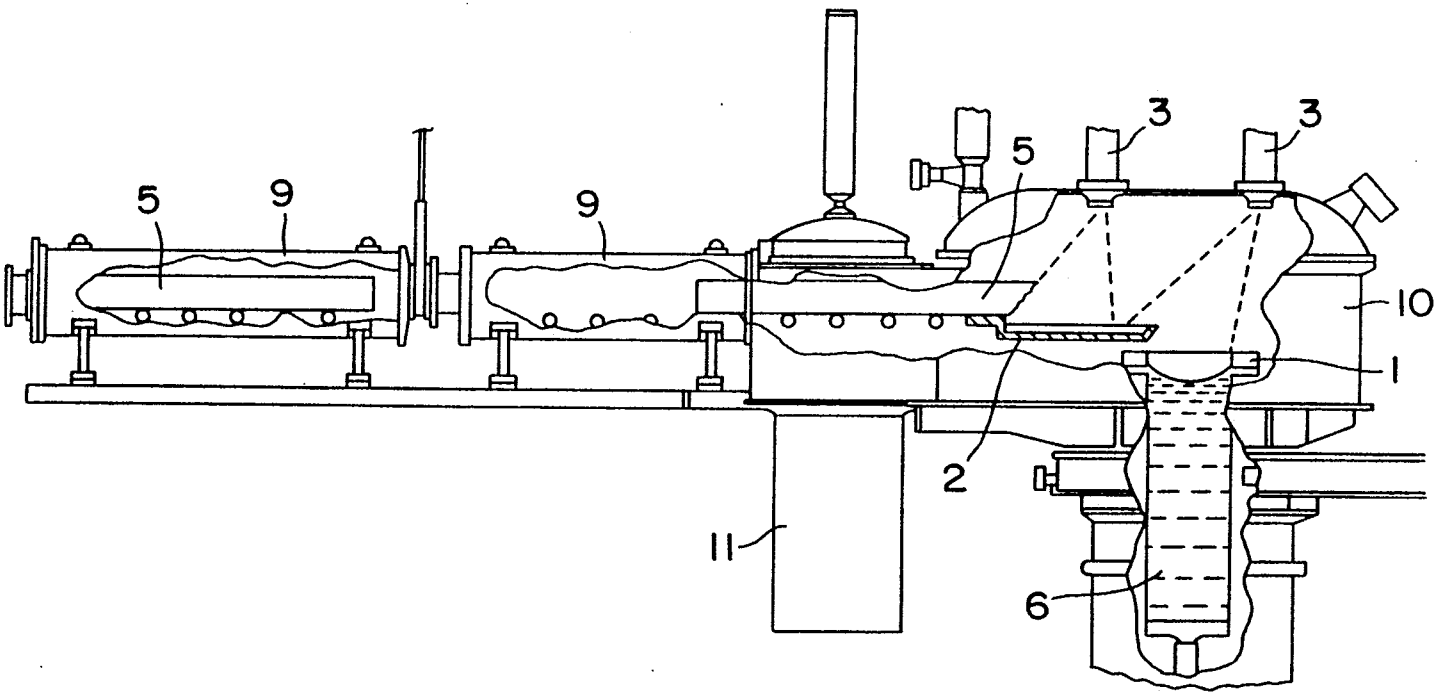
FIG. 3 is a schematic view showing typical arrangements of an electron beam melting apparatus for use in practicing the method of the invention.

In FIG. 3 is shown schematically a typical construction of an electron beam melting apparatus used in carrying the present method into practice.

As shown, meltable electrodes 5 are fed in succession into a melting chamber 10 kept in vacuum (under reduced pressure) by horizontal material feeders 9, without interfering with the vacuum state. Each electrode is melted at the rear end of a cold hearth 2 by electron beams from electron beam guns 3 and falls dropwise into the cold hearth 2. Indicated at 11 is a vacuum pump.

The molten metal that has dropped into the cold hearth 2 is exposed to the vacuum until it overflows the same. Consequently, impurity gas components such as O, N, S, C, and H are smoothly evaporated away from the melt.

At the same time, since an enclosure is formed from a metallic material having a higher vapor pressure than a refractory metal to be melted or from a metallic material which includes component or components having a higher vapor pressure than the refractory metal material, higher vapor pressure material or component(s) begins to evaporate and escape.

During this, the melting conditions are adjusted, including the wall thickness of the electrode enclosure, melting temperature, degree of vacuum in the melting chamber, surface area of the molten bath exposed to the vacuum, molten metal holding time, and casting speed. By so doing it becomes possible to effect the selective evaporation and release of the impurity gas components and the higher vapor pressure components of the electrode enclosure that are not wanted as the constituents of the objective refractory metal-based alloy. Only the component or components of the objective refractory metal-based alloy in the electrode enclosure components can be allowed to remain in the molten bath. Moreover, the adjustments of the melting conditions permit precise control of the amounts left in the bath of the component or components of the objective refractory metal-based alloy having a higher vapor pressure than the base of the alloy. The melting conditions such as the wall thickness of the electrode enclosure, melting temperature, degree of vacuum in the melting chamber, surface area of the molten bath exposed to the vacuum, molten metal holding time, and casting speed may be experimentally confirmed in advance according to the type of the objective refractory metal-based alloy ingot and the composition and shape of the electrode enclosure. Generally, adjustments within the following ranges give good result:

| | |
|---|---|
| Pressure in the melting chamber = | $10^{-2}$–$10^{-6}$ millibar |
| Electron beam output = | 200–2000 kW |
| Casting speed = | no more than 700 kg/hr. |

Thus, if an electrode enclosure is used which comprises one or two or more of the components constituting the objective refractory metal-based alloy, the composition of the refractory metal-based alloy ingot to be obtained by melting can be controlled with ease and accuracy. Any component which is rather readily lost by evaporation on electron beam melting may be added in excess beforehand to the electrode enclosure. This simply protects the ingot against deviation from the intended composition.

Next, impurities are removed by evaporation, leaving the desired components from the electrode enclosure behind. The molten metal thus overflows the cold hearth 2 and is cast into the crucible 1 to form an alloy ingot 6 of high purity.

In the case of titanium, the molten metal that has dropped into the cold hearth is exposed to the vacuum until it overflows the vessel. Consequently, "hard $\alpha$" and other inclusions in the melt are decomposed on the cold hearth; LDI floats up on the molten bath surface and are removed, while HDI settles down to the bottom of the hearth for removal. High vapor pressure components of the molten electrode enclosure too are evaporated and have no adverse effect upon the purity of the resulting titanium or titanium alloy.

The alloy components originally allowed to be present in the meltable electrode (in its enclosure or/and the mixed charge) so as to remain in the molten bath, form a solid solution satisfactorily with the alloy base Ti in the cold hearth, without the possibility of segregation.

The molten metal overflowing the cold hearth 2 is semicontinuously cast into the crucible (mold) 1. Thorough removal of impurities and diffusion of the alloy components in the cold hearth 2 give a slab 6 of high purity with only a minimum of segregation. There is no danger of the material undergoing deterioration of its mechanical properties due to nonmetallic inclusions or segregation.

Under the reasons, according to the invention, the slab 6 is cast to a square cross section and so is directly rolled without being forged beforehand. The omission of the steps such as forging and scalping permits a simplification of process and brings a marked improvement in material yield.

The use of inexpensive titanium sponge and scrap as the meltable material is very effective in reducing the overall cost.

The advantageous effects of the invention will be better understood from the following description of its examples.

EXAMPLE 1

A tube made from pure Ti of commercial purity (280 mm in outside diameter × 1500 mm in length × 1 mm in wall thickness) was packed with Mo scrap. The both open ends of the tube were closed, each with a pure Ti disc of commercial purity by TIG welding to form a meltable electrode. The total chemical analysis of the Mo scrap used was as shown in Table 1.

The meltable electrode was then melted using the electron beam melting apparatus shown in FIG. 3 under the conditions of:

| | |
|---|---|
| Pressure inside the melting chamber | $10^{-4}$ millibar |
| Electron beam output | 1500 kW |
| Melting temperature | 2680° C. |
| Surface area of molten bath in the cold hearth | 1500 $cm^2$ |
| Casting speed | 300 kg/hr |

The melt was cast into the crucible to produce a Mo-Ti-Zr alloy ingot.

The composition of the Mo-Ti-Zr alloy ingot thus obtained was analyzed. The values are also given in Table 1.

As can be seen from Table 1, the present invention makes it possible to obtain a Mo-Ti-Zr alloy ingot of a very high purity, without an extreme decrease in the Ti content which would usually be largely lost by evaporation during electron beam melting.

TABLE 1

| | Chemical Composition (by weight) | | | | | | | | |
|---|---|---|---|---|---|---|---|---|---|
| | % | | | | ppm | | | | |
| | Al | Fe | Ti | Zr | O | N | C | S | H |
| Material scrap | 0.001 | 0.005 | 2.0 | 0.08 | 110 | 10 | 180 | 1 | <1 |
| Melt-refined ingot | 0.0003 | 0.001 | 0.28 | 0.07 | 4 | <1 | 25 | <1 | <1 |

Note: The remainder is substantially Mo.

EXAMPLE 2

Tests were made on the manufacture of Mo-Ti-Zr alloy ingots under the same conditions as used in Example 1, except that the wall thickness of the pure Ti tube as the electrode enclosure and the casting speed were changed in several tests.

The Mo-Ti-Zr alloy ingots so obtained were analyzed for their alloy components (Ti and Zr). The values analyzed are listed in Table 2.

As the results shown in Table 2 clearly indicate, the present invention ensures the manufacture of Mo-Ti-Zr alloy ingots in which the Ti content is variously adjusted without a substantial influence upon the Zr content.

In this and preceding examples are described only the manufacture of Mo-Ti-Zr alloy ingots by electron beam melting of meltable electrodes which used a pure Ti tube as their enclosure. Other meltable materials and electrode enclosures may, of course, be employed instead to get similar results in the manufacture of refractory metal-based alloy ingots by electron beam melting and casting.

TABLE 2

| Test No. | Electrode enclosure: Material | Electrode enclosure: Wall thickness (mm) | Casting speed (kg/hr) | Proportions of alloy components inresulting ingot (wt %): Ti | Proportions of alloy components inresulting ingot (wt %): Zr |
|---|---|---|---|---|---|
| 1 | Pure Ti | 0.5 | 300 | 0.13 | 0.07 |
| 2 | " | 0.5 | 500 | 0.17 | 0.08 |
| 3 | " | 1 | 400 | 0.28 | 0.07 |
| 4 | " | 2 | 300 | 0.36 | 0.07 |
| 5 | " | 2 | 500 | 0.48 | 0.08 |

EXAMPLE 3

Pure Ti tubes were charged with titanium scrap alone or together with titanium sponge in the proportion shown in Table 3. The tubes were closed at both ends with pure Ti discs by welding to provide meltable electrodes.

The total analytical values of the meltable electrodes were as shown in Table 3.

The electrodes were melted and cast using the electron beam melting apparatus shown in FIG. 3 under the conditions given in Table 3 to obtain slabs with square cross section.

The slabs with square cross section could be rolled with the need of no forging.

Investigations of the material yields in the individual runs indicated more than 10% improvements over the conventional method (involving vacuum arc welding, forging followed by rolling).

TABLE 3

| Test No. | Meltable electrode: Scrap/sponge ratio (wt) | Fe (wt %) | O (wt %) | Cl (wt %) | Al (wt %) | Ti | Melting-casting condition: Pressure inside chamber (mb) | Electron beam gun output ($kW_{max.}$) | Casting speed (kg/hr) |
|---|---|---|---|---|---|---|---|---|---|
| 1 | 100/0 | 0.036 | 0.081 | <0.001 | 1.1 | bal. | $2\sim5 \times 10^{-5}$ | 540 | 310 |
| 2 | 50/50 | 0.043 | 0.062 | 0.039 | 1.2 | bal. | $2\sim8 \times 10^{-5}$ | 610 | 320 |
| 3 | 100/0 | 0.036 | 0.081 | <0.001 | 1.1 | bal. | $2\sim6 \times 10^{-5}$ | 590 | 270 |

| Test No. | Slab: Size (mm) | (kg) | Fe (wt %) | O (wt %) | Cl (wt %) | Al (wt %) | Ti |
|---|---|---|---|---|---|---|---|
| 1 | 470 × 150 × 2285$^L$ | 728 | 0.033 | 0.089 | <0.001 | <0.001 | bal. |
| 2 | 470 × 150 × 3010$^L$ | 953 | 0.036 | 0.070 | <0.001 | <0.001 | bal. |
| 3 | 1000 × 120 × 2000$^L$ | 1025 | 0.034 | 0.088 | <0.001 | <0.001 | bal. |

ADVANTAGE OF THE INVENTION

As has been described above, the present invention provides means whereby scraps are used as the raw material, the alloy composition is adjusted with extreme ease, and refractory metal-based alloy ingots with very low impurities can be produced stably at low cost on an industrial scale. With titanium, the invention offers the following advantages:

a) Scraps of irregular, intricate shapes can be utilized as materials to be melted without the need of any special pretreatment.

b) Sound slabs free from HDI or LDI are obtained as intermediates, and therefore the mechanical strength of materials is enhanced and high reliability secured.

c) No forging is required and hence no scalping.

These and other advantages combine to realize titanium and titanium alloys with excellent mechanical attributes and high enough reliability for use in jet engine parts and other exacting applications. The invention is of great industrial importance in that, in addition to these advantages, it makes possible the quantity production at low cost.

What is claimed is:

1. A method of producing a refractory metal or a refractory metal-based alloy material having at least one alloy component by electron beam cold hearth remelting, said method comprising:

(a) preparing a meltable electrode useful for electron beam cold hearth remelting by enveloping a refractory metal or refractory metal-based alloy with an enclosure, said enclosure being formed from a metal or an alloy having a vapor pressure which is higher than that of said refractory metal or refractory metal-based alloy, and (b) melting and casting said meltable electrode, while controlling the operation conditions during the electron beam cold heart remelting, so as to totally evaporate off said enclosure.

2. A method of producing a refractory metal-based alloy material having at least one alloy component by electron beam cold hearth remelting, said method comprising:

(a) preparing a meltable electrode useful for electron beam cold hearth remelting by enveloping a refractory metal-based alloy with an enclosure, wherein said enclosure is formed from a metal or an alloy selected from said at least one alloy component, and wherein said enclosure has a vapor pressure which is higher than that of said refractory metal-based alloy, and (b) melting and casting said meltable electrode, while controlling the operation conditions during the electron beam cold heart remelting, so as to control the amount of said enclosure being evaporated.

3. A method according to claim 2, wherein the evaporation loss of said at least one alloy component of said refractory metal-based alloy is compensated for by controlling the amount of said enclosure being evaporated.

4. A method according to claim 2, wherein said enclosure provides at least a partial addition of said at least one alloy component of said refractory metal-based alloy.

5. A method according to claim 2, wherein a Mo-Ti-Zr alloy material is produced by employing a meltable electrode formed by enveloping Mo scrap, which contains Ti and Zr, with an enclosure comprising pure Ti.

6. A method for producing titanium or titanium alloy by electron beam cold hearth remelting, said method comprises:

(a) preparing a meltable electrode by enveloping a material comprising at least one component selected from the group consisting of titanium sponge, titanium scrap, and a mixture thereof, with an enclosure, said enclosure being formed from a metal or an alloy having a vapor pressure which is higher than that of titanium, (b) melting and casting said meltable electrode to produce a slab with a square cross-section, while totally evaporating off said enclosure, and (c) directly rolling the slab, without subjecting the slab to forging before rolling.

7. A method according to claim 6, wherein titanium or a titanium alloy is made by employing a meltable electrode formed by enveloping a material comprising at least one component selected from the group consisting of titanium sponge, titanium scrap, and a mixture thereof, with an enclosure comprising pure aluminum.

* * * * *